US008485159B2

(12) United States Patent
Langenbach

(10) Patent No.: US 8,485,159 B2
(45) Date of Patent: Jul. 16, 2013

(54) HIGH-PRESSURE PUMP

(75) Inventor: Christian Langenbach, Erbstetten (DE)

(73) Assignee: Robert Bosch GmbH, Stuttgart (DE)

( * ) Notice: Subject to any disclaimer, the term of this patent is extended or adjusted under 35 U.S.C. 154(b) by 130 days.

(21) Appl. No.: 13/255,949

(22) PCT Filed: Jan. 19, 2010

(86) PCT No.: PCT/EP2010/050575
§ 371 (c)(1),
(2), (4) Date: Sep. 12, 2011

(87) PCT Pub. No.: WO2010/105861
PCT Pub. Date: Sep. 23, 2010

(65) Prior Publication Data

US 2011/0315120 A1 Dec. 29, 2011

(30) Foreign Application Priority Data

Mar. 16, 2009 (DE) ..... 10 2009 001 563

(51) Int. Cl.
*F02M 59/02* (2006.01)
*F02M 59/10* (2006.01)
*F04B 17/05* (2006.01)
*F04B 23/06* (2006.01)

(52) U.S. Cl.
USPC ..... 123/446; 123/456; 123/509; 123/511; 417/255; 417/307; 417/366; 417/441

(58) Field of Classification Search
USPC ..... 123/446, 456, 507–509, 511; 417/255, 417/307, 366, 441
See application file for complete search history.

(56) References Cited

U.S. PATENT DOCUMENTS

| | | | | |
|---|---|---|---|---|
| 6,196,191 | B1 * | 3/2001 | Rembold et al. | 123/447 |
| 6,422,212 | B1 * | 7/2002 | Faix et al. | 123/506 |
| 6,722,857 | B1 | 4/2004 | Kellner et al. | |
| 7,347,186 | B2 * | 3/2008 | Ricco et al. | 123/446 |
| 8,371,267 | B2 * | 2/2013 | Kristen et al. | 123/446 |

FOREIGN PATENT DOCUMENTS

| | | |
|---|---|---|
| DE | 102006048356 | 4/2008 |
| EP | 1911964 | 4/2008 |

OTHER PUBLICATIONS

PCT/EP2010/050575 International Search Report.

* cited by examiner

*Primary Examiner* — Erick Solis
(74) *Attorney, Agent, or Firm* — Michael Best & Friedrich LLP

(57) ABSTRACT

The invention relates to a high-pressure pump (2) for a fuel injection system (1) of an internal combustion engine, in particular for a common-rail injection system, comprising a driveshaft (21) supported by at least one bearing (23, 24) arranged in a bearing return (31, 31', 31"), wherein, downstream of the at least one bearing (23, 24), at least one valve (27, 28) is arranged, wherein the at least one valve (27, 28) has an opening pressure of 0.1 bar to 0.8 bar.

12 Claims, 2 Drawing Sheets

HIGH-PRESSURE PUMP

BACKGROUND OF THE INVENTION

The present invention relates to a high-pressure pump for a fuel injection system of an internal combustion engine, in particular for a common rail injection system.

High-pressure pumps for example for common-rail systems are known from the prior art, in which high-pressure pumps a drive shaft is mounted by means of plain bearings which are supplied with pressure and which serve to provide optimum lubrication and cooling. Furthermore, valves which are arranged in series with the bearings in a hydraulic circuit may be arranged downstream of the bearings in order to prevent the flows through the bearings upon start-up.

For example, DE 10 2006 048 356 A1 discloses a high-pressure fuel pump for an internal combustion engine, in which fuel inevitably flows through the bearings of the drive shaft, and as a result the mechanical and thermal load capacity of the bearings and therefore of the entire high-pressure fuel pump is considerably increased. Here, a first and a second plain bearing are provided for mounting the drive shaft. To accelerate the pressure build-up within the high-pressure fuel pump and in the high-pressure accumulator of the common-rail system, a first check valve is arranged downstream of and in series with the first bearing. Correspondingly, a second check valve is arranged downstream of and in series with the second bearing. The opening pressure of the check valves is however selected such that these are closed upon start-up of the internal combustion engine and open only when the internal combustion engine is running The opening pressure of the check valves used in the prior art lies in a range above 1.0 bar. Said opening pressure is so high that the check valves open only after the suction valves of the high-pressure fuel pump open, such that for example in a start-up situation, no leakage occurs through the bearings, which is however disadvantageous for said bearings.

Also, the pressure on the downstream side of the bearings upstream of the valves increases. If a shaft sealing ring is positioned there, the loading can increase to inadmissible values. For this reason, it is conventionally not possible for a valve to be provided at such bearings.

It is also a disadvantage of the known configurations that, in situations where there is a poor fuel supply, if a mass balance infringement occurs, the high-pressure accumulator continues to be supplied with fuel as before while the valves at the bearings are already closing. The lubrication and cooling of the bearings is in this case no longer ensured.

There is therefore a need to provide a high-pressure fuel pump which can be used in a fuel injection system, in particular in a common-rail system, and in which the mass balance situation is improved in particular upon start-up of the internal combustion engine and which does not have the disadvantages stated above.

SUMMARY OF THE INVENTION

According to the invention, a high-pressure pump for a fuel injection system of an internal combustion engine, in particular for a common rail injection system, is provided, which high-pressure pump has a drive shaft mounted by at least one bearing arranged in a bearing return, with at least one valve being arranged downstream of the at least one bearing, which valve has an opening pressure which lies in a range from 0.1 bar to 0.8 bar. With the high-pressure pump according to the invention which has the at least one valve with low opening pressure, the mass balance situation is improved in particular in the start-up situation of the internal combustion engine. The valve reduces the leakage through the at least one bearing in the start-up situation of the internal combustion engine and thereby improves the starting performance (the required rotational speed or the time required for starting). The valve with low opening pressure, which is less than or equal to 0.8 bar, opens early enough to ensure that the admissible pressure at the shaft sealing ring that is conventionally provided is not exceeded, which in turn does not inadmissibly shorten the service life.

Furthermore, the valve closes even in the event of an infringement of the low-pressure mass balance, such that a flow through the bearing is ensured in all operating situations. The high-pressure pump is therefore made more robust overall both with regard to its functionality and also with regard to durability.

The opening pressure of the valve in an opening pressure range of less than or equal to 0.8 bar and greater than or equal to 0.1 bar has the advantage that on the one hand—as already mentioned—it leads to a considerable reduction in leakages at low rotational speeds and in particular at the operating point of engine start-up, but on the other hand it ensures a minimum leakage already upon start-up. Even in the event of a massive infringement of the low-pressure mass balance in the low-pressure circuit of the fuel injection system, therefore, a minimum leakage for the at least one bearing is ensured.

The at least one valve is preferably a check valve, in particular a ball check valve.

According to a preferred embodiment, fuel can flow through the at least one bearing.

According to another preferred embodiment, the at least one bearing is a plain bearing. Therefore, a hydrostatic lubricating wedge is formed when fuel flows through the bearing, as a result of which the load capacity of the bearing is improved.

According to a further embodiment, a first bearing and a second bearing are provided in the high-pressure pump for mounting the drive shaft.

According to yet another preferred embodiment, a first valve is provided in the bearing return downstream of the first bearing and a second valve is provided in the bearing return downstream of the second bearing.

According to a further preferred embodiment, the first valve is arranged in series with the first bearing and the second valve is arranged in series with the second bearing.

Depending on the bearing point, a valve, in particular a ball check valve, may be positioned individually or positioned jointly for some or all of the bearing returns downstream of the merging thereof. The onward fuel guidance of the bearing returns is of no significance here.

The respective bearing return of the first bearing and of the second bearing preferably opens into a common bearing return, wherein a common valve is provided in the common bearing return.

The drive shaft is preferably a camshaft or an eccentric shaft which is arranged in an interior space of a pump housing.

It is also preferable for the bearing return and the interior space of the pump housing to be hydraulically connected.

The configuration according to the invention can particularly advantageously be used in all fuel injection systems which have a mechanical feed pump in the pump inflow, wherein the use is particularly advantageous in situations where no further consumers are provided in the fuel return (for example tank jet pumps, temperature switches, etc.), because then the maximum potential, that is to say the highest opening pressure in the opening pressure range according to the invention of 0.1 to 0.8 bar, can be utilized.

BRIEF DESCRIPTION OF THE DRAWINGS

Exemplary embodiments of the invention will be described in more detail below with reference to the appended drawings, in which.

DETAILED DESCRIPTION

Figure 1:
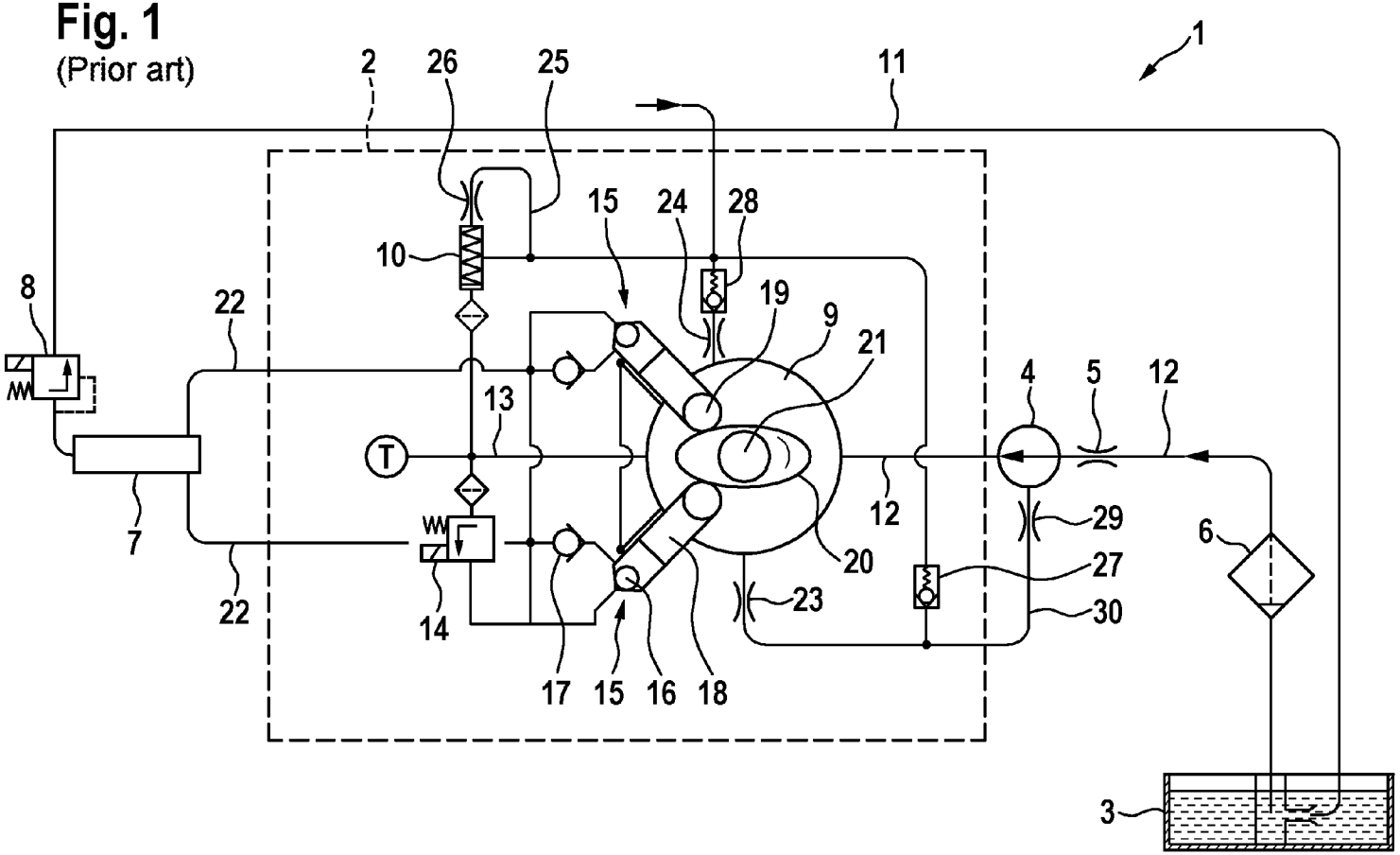
Fig. 1 (Prior art)
FIG. 1 shows a block circuit diagram of a fuel injection system having a high-pressure pump according to the prior art.

FIG. 1 illustrates a block circuit diagram of a common-rail fuel injection system 1 having a high-pressure pump 2, which system is composed substantially of a tank 3, a prefeed pump 4 with an element for feed rate limitation 5, a filter 6, a rail 7, a pressure limiting valve 8 or pressure regulating valve. The injectors which are connected to the rail 7 are not illustrated in FIG. 1.

The element for feed rate limitation 5 is designed as a throttle which is arranged directly at the inlet of the prefeed pump 4. The throttle has the effect of limiting the total fuel quantity compressed in the high-pressure pump 2. Furthermore, in this way, the resulting pressure in an interior space 9 of the high-pressure pump 2 is limited corresponding to a characteristic curve of a pressure regulating valve 10. The pressure limiting valve 8 opens into a return line 11 into which the leakage flows of the injectors (not illustrated) are also discharged. The return line 11 opens into the tank 3 and, there, drives under some circumstances a jet pump (not illustrated).

Furthermore, the temperature sensor T may be arranged in the interior of the high-pressure pump 2. The high-pressure pump 2 is hydraulically connected via a fuel inflow 12, the filter 6 and the prefeed pump 4 to the tank 3. The fuel inflow 12 connects a feed side of the prefeed pump 4 to the interior space 9 of the pump housing, such that the entire feed flow of the prefeed pump 4 passes into the interior space 9.

The prefeed pump 4 is designed as a gearwheel pump. Between the prefeed pump 4, between the rotating components and the pump housing, there is a gap which gives rise to leakage losses, as is illustrated in FIG. 1 by the symbol for a throttle (see reference numeral 29). The leakage flow flowing out through the gap is discharged through a leakage line 30. The leakage line 30 opens out, upstream of a first valve 27, into the line (without reference numeral) by means of which the fuel quantity flowing through a first bearing 23 is supplied via the first valve 27 to the return line 11.

A fuel return 13 produces a hydraulic connection between the interior space 9 of the pump housing at one side and a metering unit 14 and the return line 11 at the other side. The pressure regulating valve 10 is arranged between the fuel return 13 and the return line 11.

The metering unit 14 serves to control the fuel quantity sucked in by pump elements 15 of the high-pressure pump and therefore also the feed rate thereof. For this purpose, the suction sides of the pump elements 15 are hydraulically connected via a distributor line to the outlet of the metering unit 14.

The pump elements 15 are composed substantially of suction valves 16, high-pressure-side check valves 17, and a piston 18 which oscillates in a cylinder bore (not illustrated). The pistons 18 of the pump elements 15 are driven via roller tappets 19 by cams 20 of a drive shaft 21. The pump elements 15 feed highly pressurized fuel via a high-pressure line 22 into the rail 7.

The cams 20 are part of the drive shaft 21 which, at both sides of the cams 20, is rotatably mounted in a pump housing (not illustrated) in a first bearing 23 and in a second bearing 24 (illustrated in each case as throttles in the figure). The drive-shaft 21 is arranged in the interior space 9 of the pump housing.

Furthermore, the pressure regulating valve 10 is arranged downstream of the interior space 9 of the high-pressure pump 2. The pressure regulating valve 10 comprises a leakage line 25 in which a throttle 26 may optionally be provided. As a result of the arrangement of the pressure regulating valve 10 downstream of the interior space 9, virtually the same pressure prevails in the interior space 9 as prevails on the pressure side of the prefeed pump 4.

The elevated internal pressure in the interior space 9 of the pump housing has the effect, inter alia, that a defined fuel quantity is pressed through the bearings 23 and 24 as a function of the pressure prevailing in the interior space 9, of the viscosity of the fuel and of the flow resistance of the first bearing 23 and of a second bearing 24 of the drive shaft 21. This leads to a considerable increase in the load capacity both of the first bearing 23 and also of the second bearing 24.

Since the first bearing 23 and the second bearing 24 are formed as plain bearings, a hydrostatic lubricating wedge is formed in the bearings 23 and/or 24 by the inevitable flow through the bearings 23 and 24. As a result, the load capacity of the first bearing 23 and of the second bearing 24 is increased considerably, and at the same time the heat dissipation from the first bearing 23 and from the second bearing 24 is also improved.

To accelerate the pressure build-up within the high-pressure fuel pump 2 and in the rail 7, a first valve 27 designed as a check valve is formed downstream of and in series with the first bearing 23. Correspondingly, a second valve 28 likewise designed as a check valve is arranged downstream of and in series with the second bearing 24. The first valve 27 and the second valve 28 open into the return line 11. According to the prior art, the opening pressure of the valves 27 and 28 is greater than 1 bar and is selected such that said valves are closed upon start-up of the internal combustion engine and open only when the internal combustion engine is running.

Figure 2:
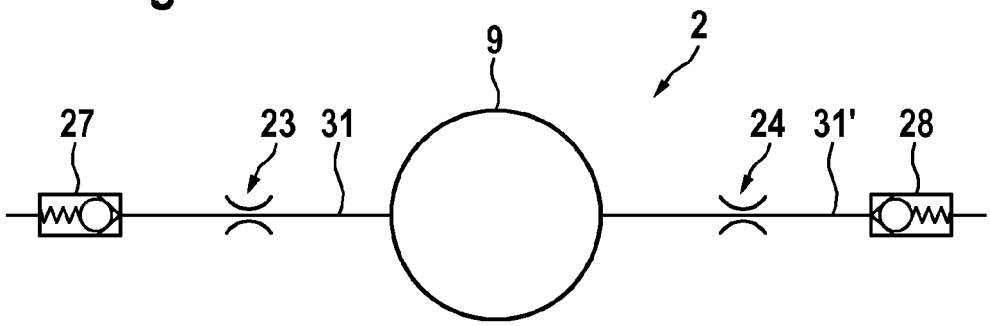
FIG. 2 shows a block circuit diagram of a section of the fuel injection system having a high-pressure pump according to one embodiment.

FIG. 2 shows a block circuit diagram of a section of the fuel injection system, which is of substantially the same construction as the fuel injection system 1 of FIG. 1, having a high-pressure pump 2 according to one embodiment. A drive shaft which is accommodated in the interior space 9 and which is not illustrated in any more detail is mounted at both sides of the interior space 9 by a first bearing 23 and a second bearing 24. The first bearing 23 and the second bearing 24 are formed as plain bearings and are arranged in each case in a bearing return 31 and 31' respectively. A first valve 27 designed as a check valve or as a ball check valve is arranged downstream of and in series with the first bearing 23. A second valve 28 likewise designed as a check valve or as a ball check valve is arranged downstream of and in series with the second bearing 24. The action and mode of operation is substantially the same as that already described in conjunction with the first and second valves 27, 28 of FIG. 1, but with the difference that the first valve 27 and/or the second valve 28 according to the embodiment have an opening pressure which is less than or equal to 0.8 bar and greater than or equal to 0.1 bar. Therefore, the first valve 27 and/or the second valve 28 are/is open upon start-up of the internal combustion engine, in contrast to the first and second valves 27, 28 of FIG. 1.

Figure 3:
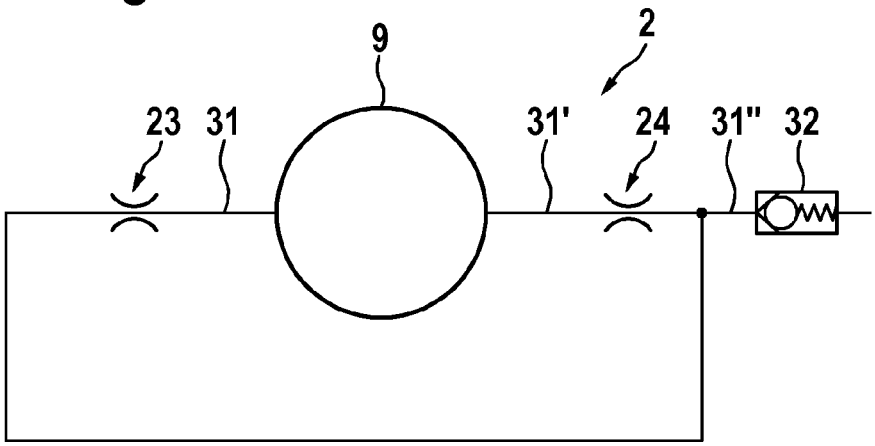
FIG. 3 shows a block circuit diagram of a section of the fuel injection system having a high-pressure pump according to a further embodiment.

FIG. 3 shows a further block circuit diagram of a section of the fuel injection system, having a high-pressure pump 2 according to a further embodiment. In contrast to the embodiment shown in FIG. 2, only one common valve 32 is provided which is designed as a check valve or as a ball check valve. Here, the common valve 32 is arranged in a common bearing return 31" into which the bearing returns 31, 31' open out. The common valve 32 in this embodiment also has an opening pressure of less than or equal to 0.8 bar and of greater than or equal to 0.1 bar, such that the common valve 32 is open upon start-up of the internal combustion engine.

Viewed overall, the configuration according to the invention provides a high-pressure pump 2 which is improved with regard to its functionality and also more robust with regard to its durability.

The invention claimed is:

1. A high-pressure pump (2) for a fuel injection system (1) of an internal combustion engine, which high-pressure pump has a drive shaft (21) mounted by at least one bearing (23, 24) arranged in a bearing return (31, 31', 31"), with at least one valve (27, 28, 32) being arranged downstream of the at least one bearing (23, 24), characterized in that the at least one valve (27, 28, 32) has an opening pressure which lies in a range from 0.1 bar to 0.8 bar.

2. The high-pressure pump (2) as claimed in claim 1, characterized in that the at least one valve (27, 28, 32) is a check valve.

3. The high-pressure pump (2) as claimed in claim 1, characterized in that the at least one bearing (23, 24) is a plain bearing.

4. The high-pressure pump (2) as claimed in claim 1, characterized in that fuel can flow through the at least one bearing (23, 24).

5. The high-pressure pump (2) as claimed in claim 1, characterized in that a first bearing (23) and a second bearing (24) are provided for mounting the drive shaft (21).

6. The high-pressure pump (2) as claimed in claim 5, characterized in that a first valve (27) is provided in the bearing return (31) downstream of the first bearing (23), and a second valve (28) is provided in the bearing return (31') downstream of the second bearing (24).

7. The high-pressure pump (2) as claimed in claim 6, characterized in that the first valve (27) is arranged in series with the first bearing (23) and the second valve (28) is arranged in series with the second bearing (24).

8. The high-pressure pump (2) as claimed in claim 5, characterized in that the respective bearing return (31, 31') of the first bearing (23) and of the second bearing (24) opens into a common bearing return (31"), wherein a common valve (32) is provided in the common bearing return.

9. The high-pressure pump (2) as claimed in claim 1, characterized in that the drive shaft (21) is a camshaft which is arranged in an interior space (9) of a pump housing.

10. The high-pressure pump (2) as claimed in claim 9, characterized in that the bearing return (31, 31', 31") and the interior space (9) of the pump housing are hydraulically connected.

11. The high-pressure pump (2) as claimed in claim 1, characterized in that the fuel injection system (1) is a common rail fuel injection system.

12. The high-pressure pump (2) as claimed in claim 2, characterized in that the check valve is a ball check valve.

* * * * *

UNITED STATES PATENT AND TRADEMARK OFFICE

CERTIFICATE OF CORRECTION

PATENT NO. : 8,485,159 B2
APPLICATION NO. : 13/255949
DATED : July 16, 2013
INVENTOR(S) : Christian Langenbach It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 59 days.

Signed and Sealed this
Eighth Day of September, 2015

Michelle K. Lee

Michelle K. Lee
*Director of the United States Patent and Trademark Office*